US007270041B2

(12) United States Patent
Cox et al.

(10) Patent No.: US 7,270,041 B2
(45) Date of Patent: Sep. 18, 2007

(54) PAPER CUTTING AND TRIMMING APPARATUS WITH REPLACEABLE, HORIZONTALLY-ORIENTED, DECORATIVE-EDGED CUTTING SHEARS

(76) Inventors: James B. Cox, 1240 S. Soderberg, Glendora, CA (US) 91740; David M Johnson, 1045 Bonnie Biae, Ontario, CA (US) 91762

( * ) Notice: Subject to any disclaimer, the term of this patent is extended or adjusted under 35 U.S.C. 154(b) by 333 days.

(21) Appl. No.: 10/937,471

(22) Filed: Sep. 10, 2004

(65) Prior Publication Data

US 2006/0005684 A1 Jan. 12, 2006

Related U.S. Application Data

(60) Provisional application No. 60/585,870, filed on Jul. 6, 2004.

(51) Int. Cl.
*B26D 5/10* (2006.01)

(52) U.S. Cl. ..... 83/607; 30/349

(58) Field of Classification Search ..... 30/349; 83/607, 605, 597

See application file for complete search history.

(56) References Cited

U.S. PATENT DOCUMENTS 27,959 A * 4/1860 Barraud ..... 83/597
1,965,443 A * 7/1934 Wyner et al. ..... 30/230
2,255,812 A * 9/1941 Rickman ..... 83/86
3,301,117 A 1/1967 Spaulding
4,056,025 A 11/1977 Rubel
4,957,025 A * 9/1990 Beno ..... 83/607
5,018,347 A * 5/1991 Feilen ..... 56/295
5,100,270 A 3/1992 Dowdle
5,320,100 A 6/1994 Herweck et al.
5,733,081 A 3/1998 Dowdle
5,865,928 A 2/1999 Lariviere
6,722,051 B2 4/2004 Carlson

OTHER PUBLICATIONS

Premier Paper Cutter. Pictures taken Dec. 11, 2006. 3 sheets.*

* cited by examiner

*Primary Examiner*—Kenneth E. Peterson
*Assistant Examiner*—Sean Michalski
(74) *Attorney, Agent, or Firm*—Eric Hanscom

(57) ABSTRACT

A device for cutting flat substances, such as paper, photographs and cardboard, adapted to provide a variety of decorative edged cuts. The cutting edges of the invention are arranged horizontally to enhance not only the quality and continuity of the decorative cuts, but also a user's ability to safely operate the invention. Cutting edges are optionally replaceable and can be stored in specially adapted holders located on the underside of the base plate cutting surface.

16 Claims, 5 Drawing Sheets

PAPER CUTTING AND TRIMMING APPARATUS WITH REPLACEABLE, HORIZONTALLY-ORIENTED, DECORATIVE-EDGED CUTTING SHEARS

CROSS REFERENCE TO RELATED APPLICATIONS

This Utility patent application is based upon Provisional Application No. 60/585,870 filed on Jul. 6, 2004.

STATEMENT REGARDING FEDERALLY SPONSORED RESEARCH OR DEVELOPMENT

This invention was not federally sponsored.

FIELD OF THE INVENTION

This invention is directed toward a paper cutting and trimming apparatus with replaceable decorative-edged cutting shears, which can be used conveniently and safely to provide a wide variety of decorative edged cuts in paper, cardboard, photos, and other flat objects.

BACKGROUND OF INVENTION

It was not long after humans learned to cut paper that they probably began experimenting with methods of creating decorative edges to enhance the messages, poems, or artwork they put on the paper as a way to convey messages and feelings to others. While today the means by which people communicate with others has expanded dramatically beyond simple paper objects—from the telephone to the internet—a nicely arranged note or poem on a piece of paper with an artistically created decorative edge remains a classic way to pass on a thought to another person. Today, the fabrication of ornamentally configured paper objects is a basic element of every elementary and secondary school curriculum. Additionally, the rising popularity of "scrap booking", that is, creatively collecting and sharing personal memories through exchange of hand-crafted scrapbooks has put a further premium on methods of creating decoratively shaped edges to paper, cardboard, and other flat materials. It has been reported that nearly 25% of U.S. households participate in "scrap booking" in one form or another, resulting in an industry which has increased in volume from $1.4 billion in 2002 to $2.55 billion in 2004.

The basic instruments used to cut paper, cardboard, and other flat materials are scissors and paper cutters. Most scissors have straight cutting surfaces, resulting in straight cuts. Cropping scissors have been manufactured to add a decorative edge in a variety of shapes to trimmed objects. However, since the average cut length from cropping scissors is around four inches, it is necessary to realign the scissors with each section cut so that the patent of the cut flows artistically from one cut to another. A failure by the user to take the time to line up each cut will result in a trimmed edge which will be marred every four inches by a pattern which abruptly stops and is continued with an incongruous section of the same pattern. In addition, a failure to line up each cut so as to continue the pattern may lead to torn or ripped edges, further destroying the artistic look desired by the user. An additional problem with cropping scissors is that the blades are not interchangeable, thereby forcing a person wanting to make a variety of decorative edged cuts to buy a variety of cropping scissors.

Another method of attempting to make decorative cuts is found in lining up a knife blade over an ornamental pattern, then using the knife to trace out and cut the paper, using the ornamental pattern as a guide. This method, in addition to the inherently safety concerns surrounding have a user, particularly a young child, using a knife sharp enough to cut paper, is limited by the manual dexterity of the user.

Thus, there has existed a need for a safe and efficient means to make decorative edged cuts on paper, cardboard, and other flat materials.

There exists prior art which discloses a number of inventions which have tried to accomplish this goal. For example, U.S. Pat. No. 5,865,928 by Lariviere teaches the use of a template having a plurality of patterns, mounding at least one graphic art object with adhesive-coated substrate to form a work piece, arranging the template over the work piece, and then drawing a cutting blade along the portion of the template defining the selected pattern, to cut along lines conforming to the selected pattern. While Lariviere's device was intended to cut collage puzzle pieces, it does effectively offer a method of putting decorative edges on flat objects such as paper and cardboard. Due to its reliance on sharp cutting knives, held in the hand by a user, it presents obvious safety concerns and would prove very time consuming should a user want to use one of the cutting channels to create the edge to a postcard or letter.

U.S. Pat. No. 6,722,051 to Carlson concerns a shape cutting system comprising a blade assembly positioned to engage at least one periphery and the edge of an opening of a template, thereby enabling the blade to cut a shape in the material which assimilates the shape of at least a portion of the periphery and edge of the template. While Carlson's invention at least partially alleviates the traditional safety concerns by having the cutting blade recessed within a cutting unit, the device is used for cutting out decorative shapes rather than providing decorative edges to flat materials.

Other shape-cutting devices include U.S. Pat. Nos. 5,733,081 and 5,100,270 to Dowdle, which deal, again, with cutting apertures in mat board rather than trimming decorative edges onto paper and cardboard, and U.S. Pat. No. 4,056,025 to Rubel, which teaches a method of cutting strip material in a straight line, rather than decorative edges.

Paper cutters are traditionally guillotine-like devices with a flat base plate and a partially rotatable lever arm, both of which have vertically aligned cutting blades which cut paper and other objects in a guillotine-like fashion. Unfortunately, along with paper these cutting devices can also cut fingers and other undesired cutting objects which are mistakenly laid in the path of the blades. While most paper cutters now come with safety devices in the form of raised barriers intended to prevent a user from accidentally cutting his or her fingers in the paper cutter, the reliance upon two vertically aligned, sharp cutting blades continues to prove a danger to children, those with limited dexterity, and heavy industrial users of these devices who desire to pay low liability insurance rates.

For example, U.S. Pat. No. 3,301,117 to Spaulding teaches a device for cutting sheet material such as paper and cardboard which is designed for safe use by children. With Spaulding's device, the sheet to be cut is placed upon a base with one side positioned against a guide rule fixed in the top surface of the board and extending perpendicularly to the rail, which has detachable blades within a blade holder mounted therein. When the rail is moved downward to clamp the sheet against the board, the lower cutting edges of the blades extending into the slot formed in the board sever the sheet as the blade holder is moved along the board. By recessing the blade within a sliding cutting unit, this invention also alleviates at least some of safety concerns, but it can only make a straight cut—not the decorative edged cuts made possible by the current invention.

Another approach to the safety issue is disclosed by U.S. Pat. No. 5,320,011 to Lee. This device is a paper cutter having a safety device, which comprises a safety latch movably attached to a cutting arm which has a safety latch base catch for engaging with a bottom surface of an extended portion of the base, an arm catch for engaging with the top surface of the arm, and a trigger for allowing a user to rotate the safety latch about the axis point to a position where the base catch disengages the extended base portion. As with Spaulding's invention, Lee's device enhances the safe operation of a method of cutting paper, but allows for only straight-edged cuts to be made.

The current invention meets the long-felt need for a paper cutting and trimming apparatus with decorative-edged cutting shears, which can be used conveniently and safely to provide a wide variety of decorative edged cuts in paper, cardboard, photos, and other flat objects, and to do so with cutting templates long enough to avoid the necessity of lining up cropping scissors every four or five inches. The current invention goes beyond meeting this need, by also teaching a system by which a variety of decorative edges can be cut by one device through the use of interchangeable cutting assemblies, which are stored in a convenient series of channels underneath the invention's base plate.

BRIEF SUMMARY OF INVENTION

It is therefore an object of this invention to provide a paper cutting and trimming apparatus with decorative-edged cutting shears, which can be used conveniently and safely to provide a wide variety of decorative edged cuts in paper, cardboard, photos, and other flat objects.

It is a further object of this invention that a single device can provide numerous edge shapes through the use of easily exchanged cutting assemblies.

It is a final object of this invention that the cutting assemblies that are not being used can be stored efficiently in slots manufactured into the bottom of the base plate of the invention.

Other and further objects and features of this invention will be apparent to one skilled in the art.

DETAILED DESCRIPTION OF THE INVENTION

Figure 1:
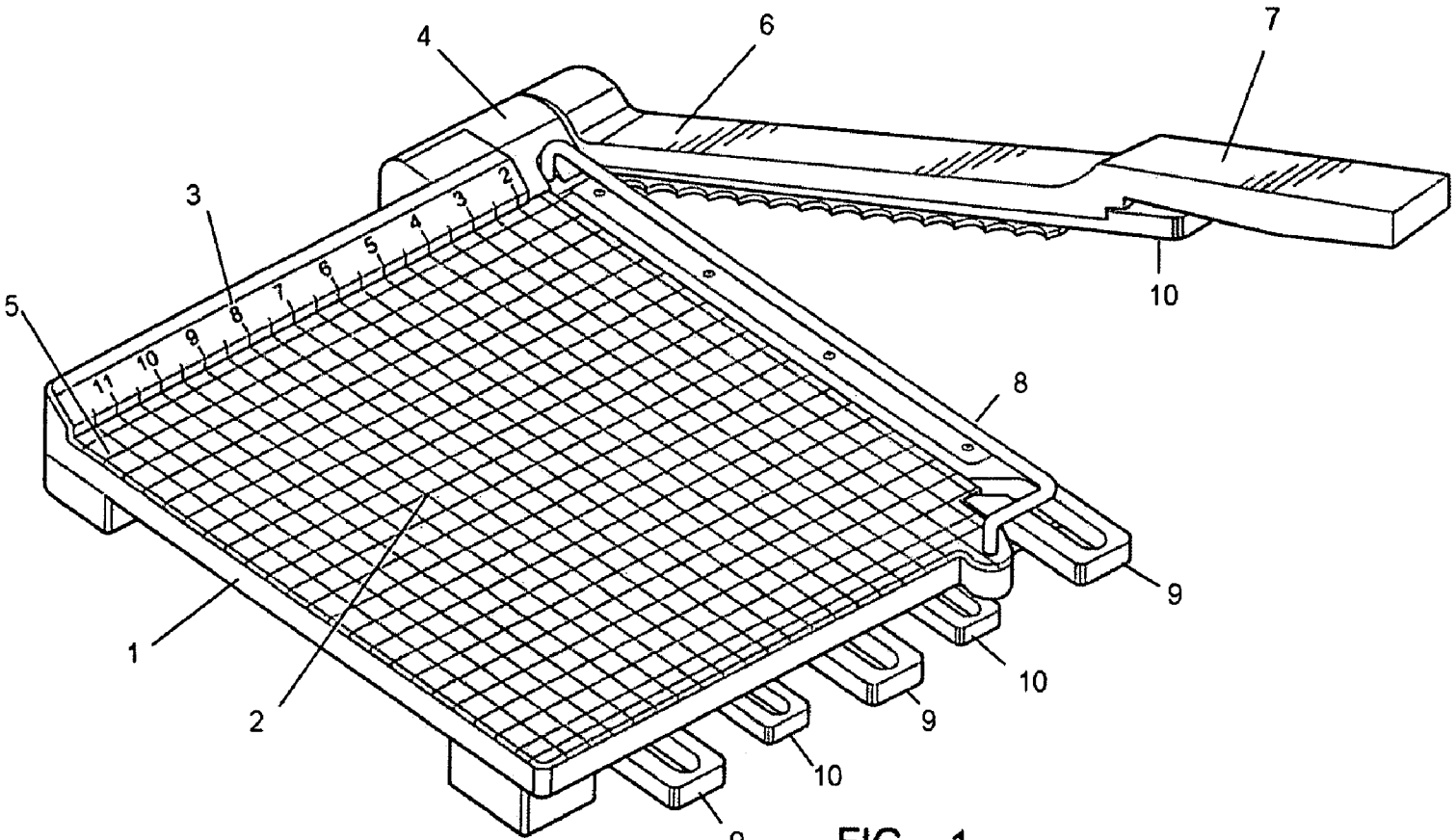
FIG. 1 is a perspective view of the invention showing its major external parts, as visible from a common perspective looking down upon the invention from the front, left side.

The present invention is directed to a device for cutting flat substances, such as paper, photographs and cardboard, adapted to provide a variety of decorative edged cuts. The cutting edges of the invention are arranged horizontally to enhance not only the quality and continuity of the decorative cuts, but also a user's ability to safely operate the invention. Cutting edges are replaceable and can be stored in specially adapted holders located on the underside of the cutting surface.

Referring to the drawings the invention consists of a flat base plate, cross-hatched with a grid which can be used for measuring cuts and lining up the material to be cut. One end of the base plate is raised to form a guide edge to provide an edge against which the material is stabilized for measuring and cutting. The invention has a lever arm which is rotatably attached to one end of the base plate. On the lever arm is a means of attachment into which can be slid a variety of lever arm blade assemblies, each of which has built into it a different decorative edge. As a counterpart to each of the different decorative edges on the lever arm blade assemblies, there is a matching base plate decorative edge built into a base plate blade assembly. The lever arm blade assembly and the base plate blade assembly are manufactured such that the blades mate in a cutting action in a horizontal manner, which not only avoids the danger inherent in the "guillotine cut" of traditional paper cutters, but also allows for a unique, reciprocal cutting method which allows for clean decorative cuts. Both of the blade assemblies slide into dove-tailed receiving slots, and have handles with locking mechanisms which allow a user to quickly and efficiently insert, lock for use, then remove the blade assemblies which the user wishes to use another blade assembly with a different decorative edge.

FIG. 1 is a perspective view of the invention showing its major parts, as visible from a common perspective looking down upon the invention from the front, left side. There is a base plate (1) which is a flat piece of metal, plastic, or similar sturdy material. Upon the surface of the base plate is a series of cross-hatched gridlines (2) which can be either embedded into the surface of the base plate and/or printed on the base plate during its manufacture. Along one edge of the base plate, there is a raised guide edge (5) which rises out of the base plate (1) at a 90 degree angle, and serves as a guide against which the material to be cut is laid for measuring and to assure a straight cut. The raised guide edge has a measuring device (3), or ruler, which can be either embedded into the surface of the base plate and/or printed on the base plate during its manufacture. On the edge of the base plate which has the raised guide there is also a block (4), through which there is a hole (not shown in this figure), through which a bolt (not shown in this figure) slides and attaches to the block a lever arm (6). Into the base plate (1) there is manufactured an indentation (15) which allows a user to easily grab the handle portion of the base plate cutting assembly.

The lever arm (6) extends the length of the base plate (1) and terminates in a handle (7) which allows a user to convenient raise and lower the lever arm to cut flat materials placed on the base plate. There is a safety guard (8) which prevents a user's fingers from getting to the edge of the horizontal cutting implements (not shown in this figure). There is also a base plate cutting assembly (9) attached to the base plate (1) and a lever cutting assembly (10) attached to the lever arm (6), which will be discussed and described in more detail in additional figures. There are additional base plate cutting assemblies (9) and lever cutting assemblies (10) which are stored in storage slots (not shown) contained in the base plate (1).

Figures 2, 3:
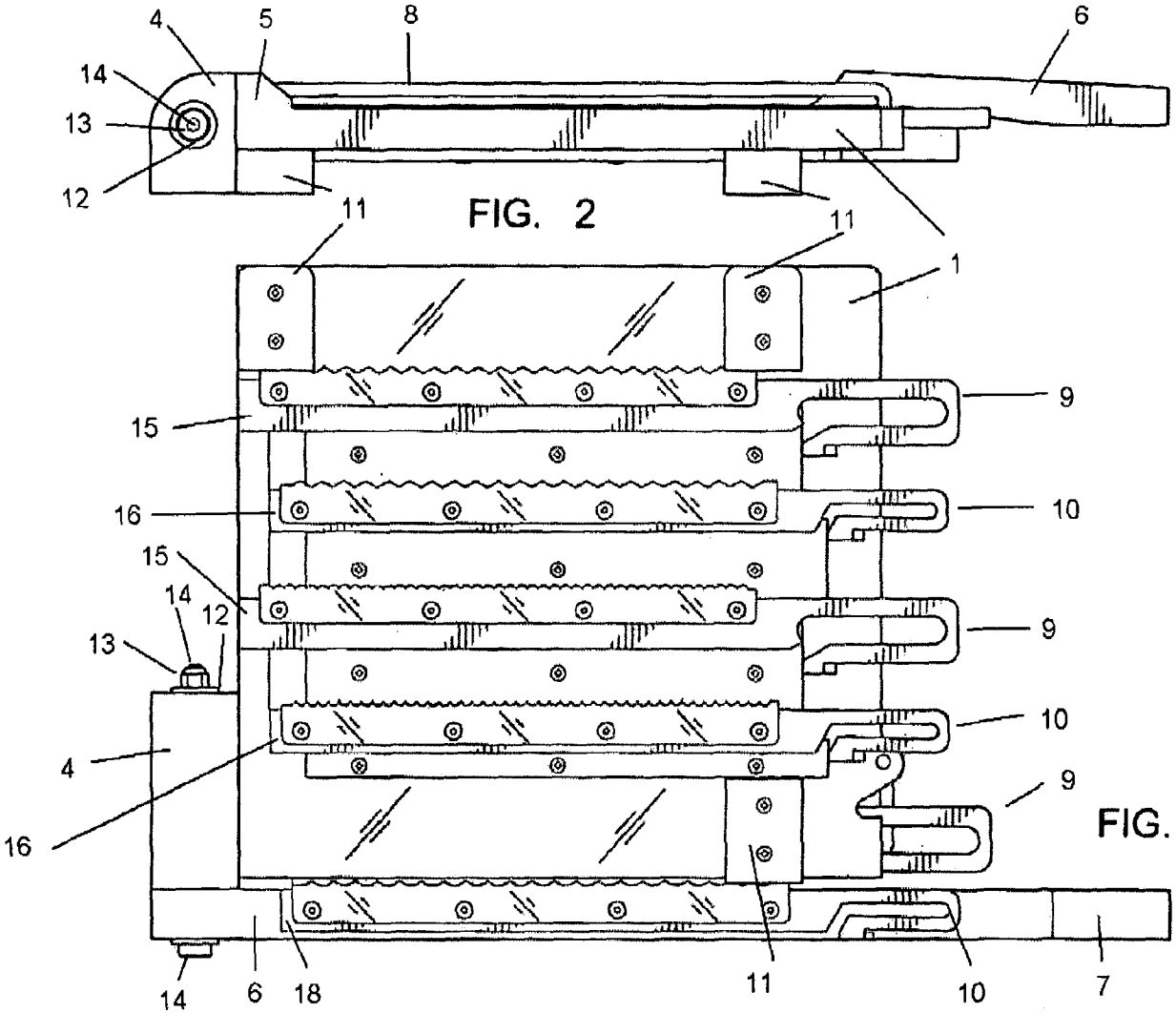
FIG. 2 is a side view of the invention.
FIG. 3 is a bottom view of the invention.

FIG. 2 is a side view of the invention with the lever (6) facing away from the viewer. Attached to the base plate (1) is a safety guard (8). Also attached to the base plate (1) are foot braces (11) which support the base plate while the invention is being used. The raised guide edge (5) can also be seen, which rises out of the base plate (1) at a 90 degree angle. There is also a block (4), through which there is a hole (not shown in this figure) through which a bolt (14) slides and attaches to the block (4) the lever arm (6). A spring washer (12) and lock nut (13) are used to tighten and secure the bolt thereby holding the lever (6) to the block (4).

FIG. 3 is a bottom view of the invention. Attached to the base plate (1) are three foot braces (11). Attached to the back of the base plate (1) is the block (4), through which there is a hole (not shown in this figure). Through this hole slides a bolt (14) which attaches the block (4) to the lever arm (6). A spring washer (12) and lock nut (13) are used to tighten and secure the bolt thereby holding the lever (6) to the block (4). The lever arm (6) extends the length of the base plate (1) and terminates in a handle (7). Also shown in this figure are various base plate cutting assemblies (9) and lever cutting assemblies (10). Two base plate cutting assemblies (9) are stored in base plate cutting assembly storage slots (15). Two lever cutting assemblies (10) are stored in lever cutting assembly storage slots (16). The base plate cutting assembly storage slots (15) and the lever cutting assembly storage slots (16) are designed so that the handles of the base plate cutting assemblies (9) and the lever cutting assemblies (10) extend beyond the base plate (1) to allow users to insert and remove the base plate cutting assemblies (9) and the lever cutting assemblies (10). A lever cutting assembly (10) is shown attached to the lever arm (6) in the lever receiving slot (18) and a base plate cutting assembly (9) is shown attached to the base plate (1) in the base plate receiving slot (not shown in this figure).

Figure 4:
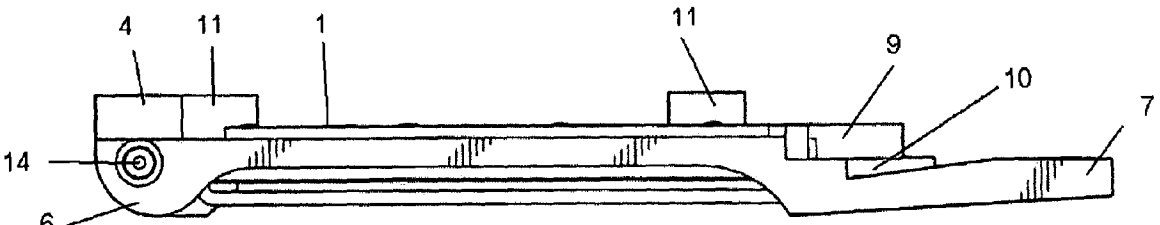
FIG. 4 is an upside-down side view of the invention.

FIG. 4 is an upside down side view of the invention, with the lever arm (6) facing the viewer. The lever arm (6) extends the length of the base plate (1) and terminates in a handle (7). The lever arm (6) is attached by means of a bolt (14) to the block (4), which in turn is attached to the base plate (1). The foot braces (11) are attached to the bottom of the base plate (1). The safety guard (8) is attached to the base plate (1). The lever cutting assembly (10) is inserted into the lever receiving slot (not shown in this figure) thereby attaching it to the lever arm (6). The base plate cutting assembly (9) is inserted into the base plate receiving slot (not shown in this figure) thereby attaching it to the base plate (1).

Figure 5:
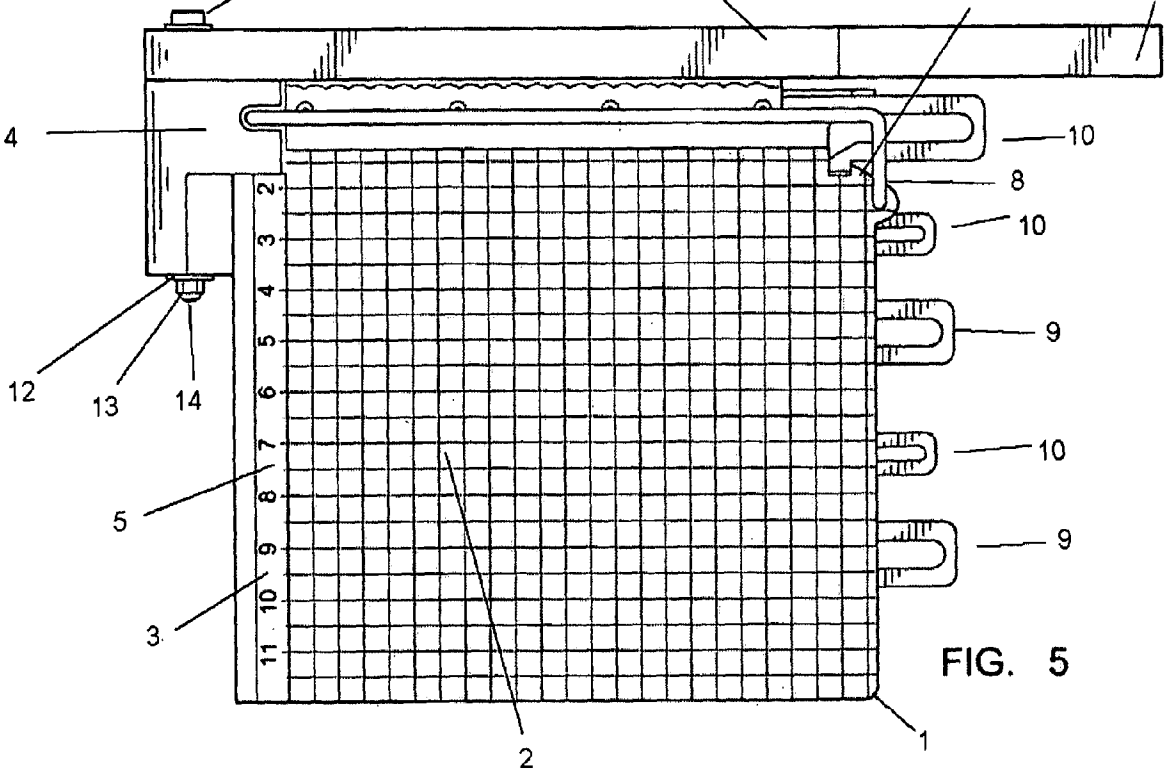
FIG. 5 is a top view of the invention.

FIG. 5 is a top view of the invention. There is a base plate (1) which is a flat piece of metal, plastic, or similar sturdy material. Upon the surface of the base plate is a series of cross-hatched gridlines (2) which can be either embedded into the surface of the base plate and/or printed on the base plate during its manufacture. Along one edge of the base plate, there is a raised guide edge (5) which rises out of the base plate (1) at a 90 degree angle, and serves as a guide against which the material to be cut is laid for measuring and to assure a straight cut. The raised guide edge has a measuring device (3), or ruler, which can be either embedded into the surface of the base plate and/or printed on the base plate during its manufacture. Into the base plate (1) there is manufactured an indentation (19) which allows a user to easily grab the handle portion of the base plate cutting assembly. On the edge of the base plate which has the raised guide (5) there is also a block (4), through which there is a hole (not shown in this figure) through which a bolt (14) slides and attaches to the block (4) the lever arm (6). A spring washer (12) and lock nut (13) are used to tighten and secure the bolt thereby holding the lever (6) to the block (4).

The lever arm (6) extends the length of the base plate (1) and terminates in a handle (7) which allows a user to convenient raise and lower the lever arm to cut flat materials placed on the base plate. There is a safety guard (8) which prevents a user's fingers from getting to the edge of the horizontal cutting implements (not shown in this figure). There is also a base plate cutting assembly (9) attached to the base plate (1) and a lever cutting assembly (not shown in this figure) attached to the lever arm (6), which will be discussed and described in more detail in additional figures. There are additional base plate cutting assemblies (9) and lever cutting assemblies (10) which are stored in storage slots (not shown) contained in the base plate (1).

Figure 6:
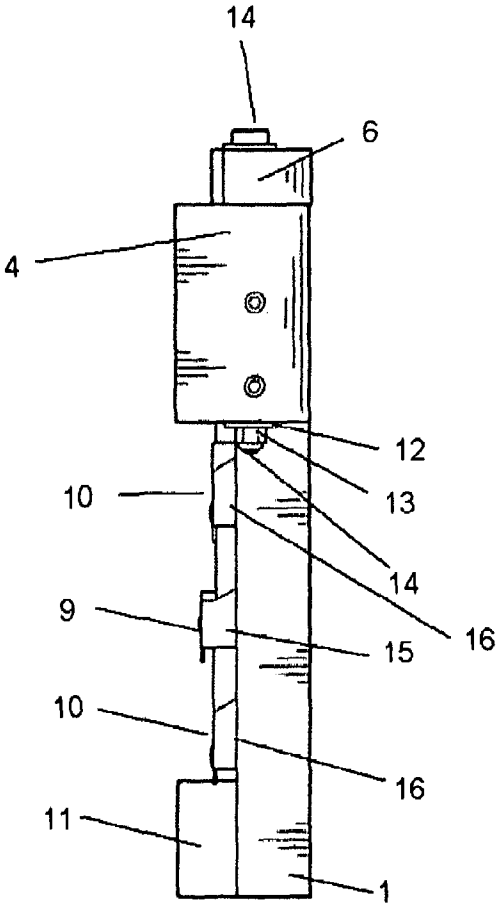
FIG. 6 is rear view of the invention.

FIG. 6 is a rear view of the invention. The base plate (1) has attached to it a foot brace (11). In this view there is one base plate cutting assembly (9) that is stored in a base plate cutting assembly storage slot (15). Two lever cutting assemblies (10) are stored in lever cutting assembly storage slots (16). These slots store unused cutting assemblies by securing them to the base plate (1). Attached to the base plate (1) is a block (4). The lever arm (6) is attached to the block (4) by means of a bolt (14) that goes through both the lever arm (6) and the block (4). The bolt (14) is secured to the block (4) and lever arm (6) by a lock nut (13) and a spring washer (12).

Figure 7:
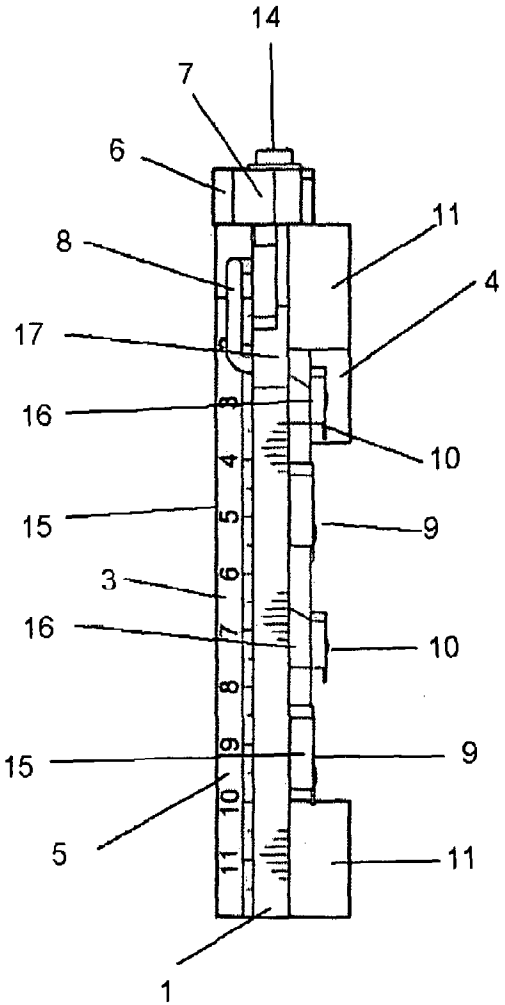
FIG. 7 is a front view of the invention.

FIG. 7 is a a front view of the invention. Along the far edge of the base plate, there is a raised guide edge (5) which rises out of the base plate (1) at a 90 degree angle, and serves as a guide against which the material to be cut is laid for measuring and to assure a straight cut. The raised guide edge has a measuring device (3), or ruler, which can be either embedded into the surface of the base plate and/or printed on the base plate during its manufacture. To support the base plate (1) while the invention is in use are foot braces (11) which are attached to the base plate (1). Also attached to the base plate, but on the opposite side, is the safety guard (8). There is a base plate cutting assembly (9) that is secured in the base plate receiving slot (17), which secures the base plate cutting assembly (9) to the base plate (1). Two base plate cutting assemblies (9) are stored in base plate cutting assembly storage slots (15). Two lever cutting assemblies (10) are stored in lever cutting assembly storage slots (16). The lever arm (6) is attached to the block (4) by means of a bolt (14). The block (4) is permanently attached to the base plate (1).

Figure 8:
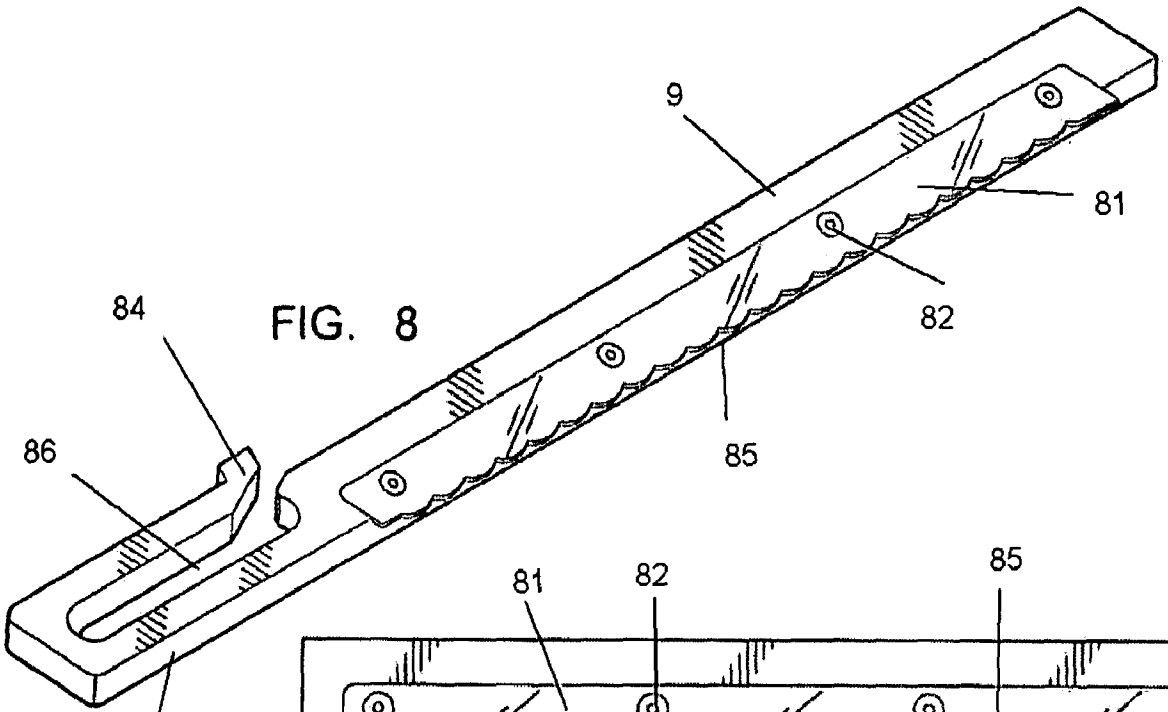
FIG. 8 is a perspective view of a base plate cutting assembly.

FIG. 8 is a perspective view of a base plate cutting assembly (9). The base plate cutting blade (81) is attached to the base plate cutting member (80) by means of screws, rivets, or other similar fastening devices (82). The base plate cutting blade (81) has a non-straight decorative cutting edge (85). At one end of the base plate cutting member (80) is a handle (83). The handle (83) has a lock (84), which allows a user to insert the base plate cutting assembly (9) into a base plate receiving slot and lock it in place until the user wishes to remove it and replace it with another blade assembly with a different decorative edge cutting apparatus. The handle (83) is shaped in a rough semi-circle and is made of plastic, fiberglass, or a similar flexible vet sturdy material such that the lock (84) can be pressed in with a user's thumb to lock and unlock from the base plate receiving slot with relative ease, the direction of movement indicated by number (86).

Figure 9:
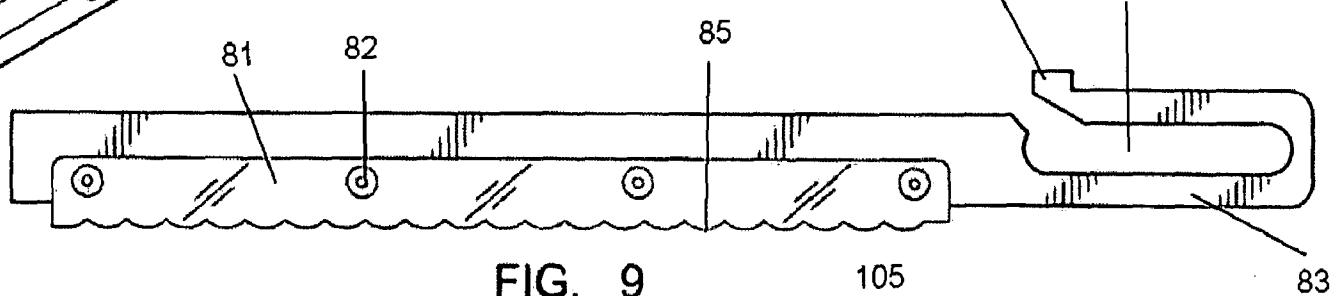
FIG. 9 is a top view of a base plate cutting assembly.

FIG. 9 is a top view of a base plate cutting assembly (9). The base plate cutting blade (81) is attached to the base plate cutting member (80) by means of screws, rivets, or other similar fastening devices (82). The base plate cutting blade (81) has a non-straight decorative cutting edge (85). At one end of the base plate cutting member (80) is a handle (83). The handle (83) has a lock (84), which allows a user to insert the base plate cutting assembly (9) into a base plate receiving slot and lock it in place until the user wishes to remove it and replace it with another blade assembly with a different decorative edge cutting apparatus. The handle (83) is shaped in a rough semi-circle and is made of plastic, fiberglass, or a similar flexible vet sturdy material such that the lock (84) can be pressed in with a user's thumb to lock and unlock from the base plate receiving slot with relative ease, the direction of movement indicated by number (86).

Figure 10:
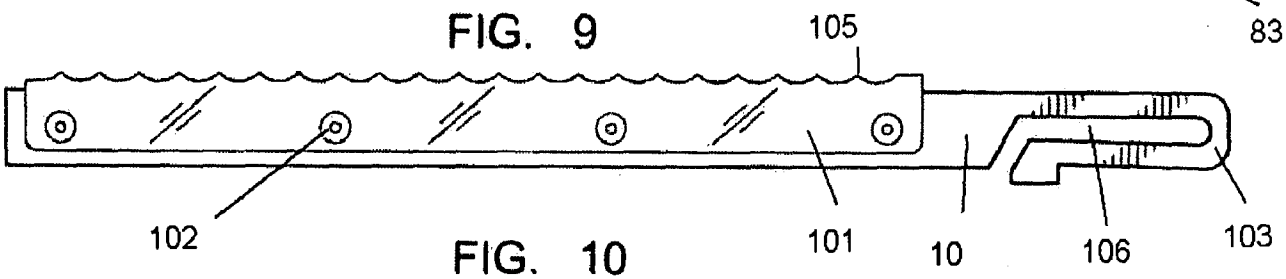
FIG. 10 is a top view of a lever cutting assembly.

FIG. 10 is top view of a lever cutting assembly (10). The lever cutting blade (101) is attached to the lever cutting member (100) by means of screws, rivets, or other similar fastening devices (102). The lever cutting blade (101) has a non-straight decorative cutting edge (105). At one end of the lever member (100) is a handle (103). The handle (103) has a lock (104), which allows a user to insert the lever cutting assembly (10) into a lever receiving slot and lock it in place until the user wishes to remove it and replace it with another blade assembly with a different decorative edge cutting apparatus. The handle (103) is shaped in a rough semi-circle and is made of plastic, fiberglass, or a similar flexible yet sturdy material such that the lock (104) can be pressed in with a user's thumb to lock and unlock from the lever receiving slot with relative ease, the direction of movement indicated by number (106).

We claim:

1. A tool for cutting flat materials comprising:

a flat base plate comprising a cross-hatched grid of measuring lines, a receiving slot which is a track built into the base plate, where the receiving slot has a beveled edge, an indentation in the base plate that allows a user to easily grasp a base plate cutting assembly for removal once it has been attached, and a guide edge with ruled lines which serves to measure a piece of flat material to be cut and provide a solid baseline against which the flat material can rest during measuring and cutting, a base plate cutting assembly comprising a base plate cutting member and a base plate cutting blade which is a flat piece of metal attached to the base plate cutting member by screws, rivets, or similar means of attachment, where the edge of the base plate cutting blade is a non-straight decorative pattern, where the base plate cutting member has a beveled surface on one side, where the base plate cutting assembly is removable and exchangeable and can be slid into and removed from the receiving slot in the base plate where the two beveled edges align and allow for the base plate cutting assembly to be inserted into the receiving slot in the base plate in only one orientation, a lever attached movably at one end of the base plate such that the lever can be raised or lowered such that it pivots about a point of attachment between the lever and the base plate, a recessed bolt hole in the lever at the end of the lever attached to the base plate, where the recessed bolt hole is shaped and sized in the shape and size of a head of the bolt, thereby assuring that once the bolt is slid into the recessed bolt hole, it will not rotate, a lock washer and a lock nut which are used to tighten the bolt, thereby ensuring that the lever is tightened sufficiently to line up the base plate cutting edge and the lever cutting edge, but not so tight as to unduly restrict its movement, a lever cutting assembly comprising a lever cutting member and a lever cutting blade which is a flat piece of metal attached to the lever cutting member by screws, rivets, or similar means of attachment, where the edge of the lever cutting blade is a non-straight decorative pattern, and where the lever cutting assembly can be attached to the lever, a safety barrier, and a plurality of foot braces numbering at least three.

2. The tool of claim 1, where the lever has a receiving slot, where the receiving slot is a track built into the lever, where the receiving slot has a beveled edge, and where the lever cutting member has a beveled surface on one side, where the lever cutting assembly is removable and exchangeable and can be slid into and removed from the receiving slot in the lever where the two beveled edges align and allow for the lever cutting assembly to be inserted into the receiving slot in the lever in only one orientation.

3. The tool of claim 2, where, the base plate cutting member and the lever cutting member are constructed from a material which is rigid enough so that it will maintain its shape and yet be flexible enough such that a lock at the end of the base plate cutting member can flexibly slide over a lock projection on the base plate, thereby fixing the base plate cutting assembly in a position on the base plate, and a lock at the end of the lever cutting member can flexibly slide over a over a lock projection on the lever, thereby fixing the lever cutting assembly in a position on the lever, whereby the cutting edges of the lever cutting blade and the base plate cutting blade are aligned for cutting flat material laid on the base plate and aligned between the two cutting edges.

4. The base plate of claim 3, where, the base plate has one or more storage slots built into its underside which can accommodate one or more exchangeable lever cutting assemblies and base plate cutting assemblies.

5. The storage slots of claim 4, where the storage slots have one beveled edge and are of a configuration where a lever cutting assembly or a base plate cutting assembly can be slid into and removed from a storage slot in the base plate where the two beveled edges align and allow for a lever cutting assembly or a base plate cutting assembly to be inserted into the storage slot in the base plate in only one orientation.

6. The storage slots of claim 5, where each of the storage slots has a lock projection manufactured into it, over which the lock of the base plate cutting member or lever cutting member can slip, thereby locking the base plate cutting member or lever cutting member into the storage slot.

7. The device of claim 5, where the base plate measures less than six inches.

8. The device of claim 5, where the base plate measures between six inches and 12 inches on a side.

9. The device of claim 5, where the base plate measures between 12 inches and 24 inches on a side.

10. The device of claim 5, where the base plate measures between 24 and 36 inches on a side.

11. The device of claim 5, where the base plate measures greater than 36 inches on a side.

12. The storage slots of claim 6, where the lock projections are semi-hemispherical in nature.

13. The device of claim 12, where the base plate and lever are made of metal.

14. The device of claim 12, where base plate, lever, base plate member and lever member are made of plastic.

15. The device of claim 12, where the indentation in the base plate is rectangular in shape.

16. The device of claim 12, where the indentation in the base plate is semi-circular in shape.

* * * * *